United States Patent [19]

Hasty

[11] 4,013,069

[45] Mar. 22, 1977

[54] SEQUENTIAL INTERMITTENT COMPRESSION DEVICE

[75] Inventor: James H. Hasty, Cary, Ill.

[73] Assignee: The Kendall Company, Boston, Mass.

[22] Filed: Oct. 28, 1975

[21] Appl. No.: 625,990

[52] U.S. Cl. ..... 128/24 R; 128/DIG. 15; 128/DIG. 20; 128/64

[51] Int. Cl.[2] ..... A61H 1/00

[58] Field of Search ..... 128/24 R, 60, DIG. 20, 128/64, 38–40, 297, 299, 25 R, 89

[56] References Cited

UNITED STATES PATENTS

| | | | |
|---|---|---|---|
| 1,608,239 | 11/1926 | Rosett | 128/24 R |
| 2,361,242 | 10/1944 | Rosett | 128/24 R |
| 2,528,843 | 11/1950 | Poor | 128/24 R |
| 2,533,504 | 12/1950 | Poor | 128/64 |
| 2,781,041 | 2/1957 | Weinberg | 128/60 |
| 2,823,668 | 2/1958 | VanCourt et al. | 128/DIG. 20 |
| 3,177,866 | 4/1965 | Wesslund | 128/24 R |
| 3,332,415 | 7/1967 | Ericcson | 128/DIG. 20 |
| 3,454,010 | 7/1969 | Lilligren et al. | 128/24 R |
| 3,536,063 | 10/1970 | Werding | 128/24 R |
| 3,548,809 | 12/1970 | Conti | 128/64 X |
| 3,862,629 | 1/1975 | Rotta | 128/24 R |
| 3,885,554 | 5/1975 | Rockwell | 128/24 R |
| 3,901,225 | 8/1975 | Sconce | 128/89 R |

*Primary Examiner*—Lawrence W. Trapp
*Attorney, Agent, or Firm*—Powell L. Sprunger

[57] ABSTRACT

A device for applying compressive pressures against a patient's limb from a source of pressurized fluid. The device has an elongated pressure sleeve for enclosing a length of a patient's limb, with the sleeve having a plurality of separate fluid pressure chambers progressively arranged longitudinally along the sleeve from a lower portion of the limb to an upper portion of the limb proximal the patient's heart relative the lower portion. The device has means for intermittently forming a plurality of fluid pressure pulses from the source in a timed sequence during periodic compression cycles. The device also has means for connecting the different pressure pulses of the sequence to separate chambers in the sleeve in an arrangement with later pulses in the sequence being connected to more upwardly located chambers in the sleeve to apply a compressive pressure gradient against the patient's limb by the sleeve which decreases from the lower to upper limb portions. The device also has means for intermittently connecting the chambers to an exhaust means during periodic decompression cycles between the compression cycles.

41 Claims, 11 Drawing Figures

Fig. 1
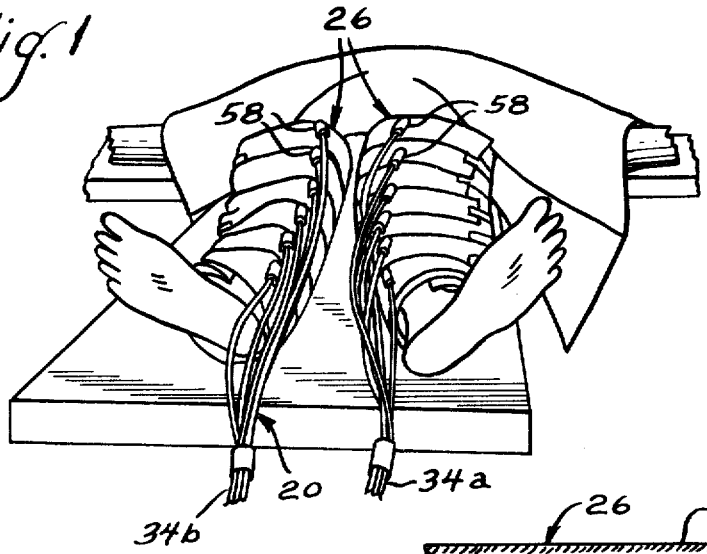
Fig. 2
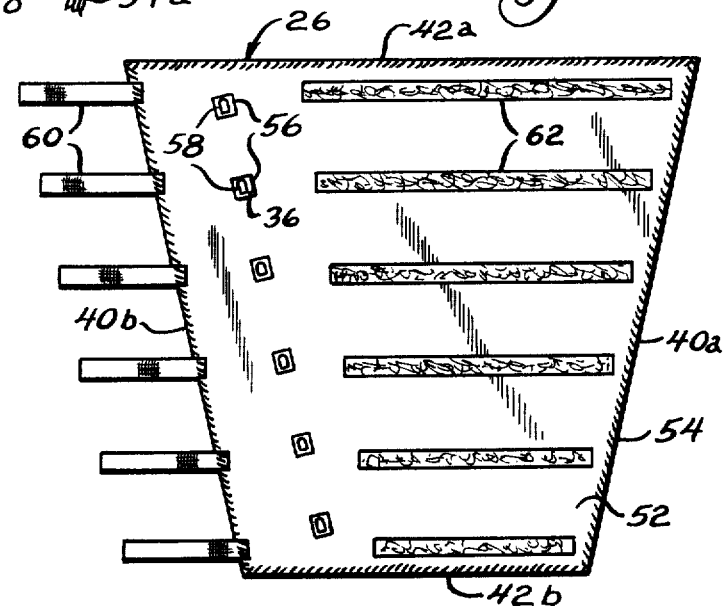
Fig. 3
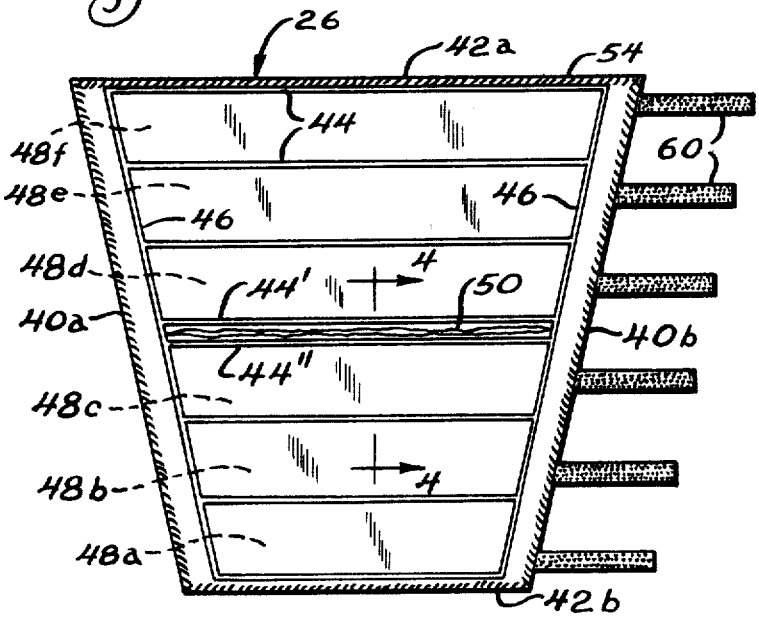
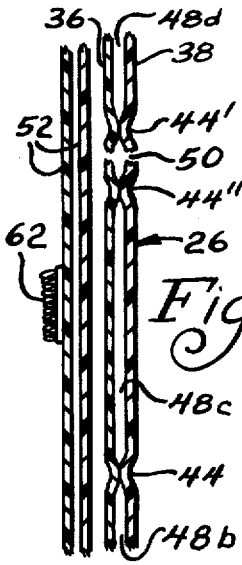
Fig. 4

SEQUENTIAL INTERMITTENT COMPRESSION DEVICE

BACKGROUND OF THE INVENTION

The present invention relates to therapeutic and prophylactic devices, and more particularly to devices for applying compressive pressures against a patient's limb.

It is known that the velocity of blood flow in a patient's extremities, particularly the legs, markedly decreases during confinement of the patient. Such pooling or stasis of blood is particularly pronounced during surgery, immediately after surgery, and when the patient has been confined to bed for extended periods of time. It is also known that stasis of blood is a significant cause leading to the formation of thrombi in the patient's extremities, which may have a severe deleterious effect on the patient, including death. Additionally, in certain patients it is desirable to move fluid out of interstitial spaces in extremity tissues, in order to reduce swelling associated with edema in the extremities.

SUMMARY OF THE INVENTION

A principal feature of the present invention is the provision of a device of simplified construction for applying compressive pressures against a patient's limb in an improved manner.

The device of the present invention comprises, an elongated pressure sleeve for enclosing a length of the patient's limb, with the sleeve having a plurality of separate fluid pressure chambers progressively arranged longitudinally along the sleeve from a lower portion of the limb to an upper portion of the limb proximal the patient's heart relative the lower portion. The device has means for intermittently forming a plurality of fluid pressure pulses from a source of pressurized fluid in a timed sequence during periodic compression cycles. The device has means for connecting the different pressure pulses of the sequence to separate chambers in the sleeve in an arrangement with later pulses in the sequence being connected to more upwardly located chambers in the sleeve. The device has means for intermittently connecting the chambers to an exhaust means during periodic decompression cycles between the compression cycles.

A feature of the present invention is that the device applies a compressive pressure gradient against the patient's limb by the sleeve which decreases from the lower to upper limb portions.

Another feature of the present invention is that the device may be adjusted to control the duration of the compression cycles.

Yet another feature of the invention is that the device may be adjusted to control the duration of the decompression cycles between the intermittent compression cycles.

Still another feature of the invention is that the duration of the timed intervals between the fluid pressure pulses may be separately adjusted to control initiation of compression by selected chambers.

Thus, a feature of the present invention is that the timing of the applied pressure gradient, as well as the compression and decompression cycles, may be suitably modified to conform with the physiology of the patient.

The connecting means of the device preferably connects each of the pressure pulses to sets of adjoining chambers in the sleeve, such that different pulses are connected to contiguous sets of adjoining chambers. The device also has means for progressively decreasing the rate of pressure increases in progressively located upper chambers of each adjoining chamber set.

Thus, a feature of the invention is that different pulses are sequentially applied to separate sets of adjoining chambers.

Another feature of the invention is that the pressure rise times in the adjoining chambers of each set are controlled to produce a progressively decreasing compressive pressure profile in the chambers of each set.

Yet another feature of the invention is that the pressure rise times in the chambers of progressively located chamber sets are controlled to produce a desired compressive pressure profile from a lower to upper portion of the sleeve.

Still another feature of the invention is that the forming means preferably forms later pulses in the sequence from a preceding pulse in the sequence to prevent a possible inversion of the compressive pressure gradient.

A feature of the present invention is that the device applies continued pressure against a lower portion of the leg while an upper portion of the leg is being compressed.

Yet another feature of the invention is that the sleeve preferably defines chambers having progressively increasing volumes progressively upwardly along the sleeve to facilitate formation of a compressive pressure profile against the limb which decreases from a lower to upper portion of the sleeve.

Still another feature of the invention is that the device empties the sleeve during the decompression cycles while maintaining a pressure profile which decreases from a lower to upper portion of the sleeve.

Further features will become more fully apparent in the following description of the embodiments of this invention and from the appended claims.

DESCRIPTION OF THE DRAWINGS

In the drawings:

FIG. 1 is a perspective view of a pair of compression sleeves used in the sequential intermittent compression device of the present invention;

FIG. 2 is a front plan view of a compression sleeve of FIG. 1;

FIG. 3 is a back plan view of the sleeve of FIG. 2;

FIG. 4 is a sectional view taken substantially as indicated along the line 4—4 of FIG. 3;

DESCRIPTION OF THE PREFERRED EMBODIMENTS

Figure 6:
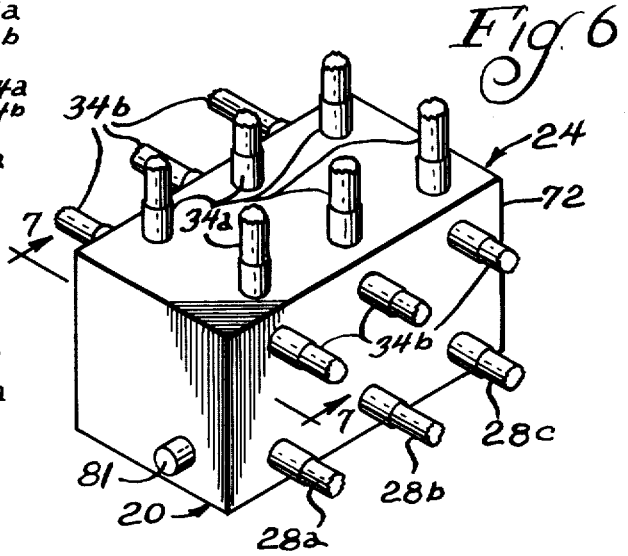
FIG. 6 is a perspective view of the manifold for use with the device of FIG. 1.
Figure 9:
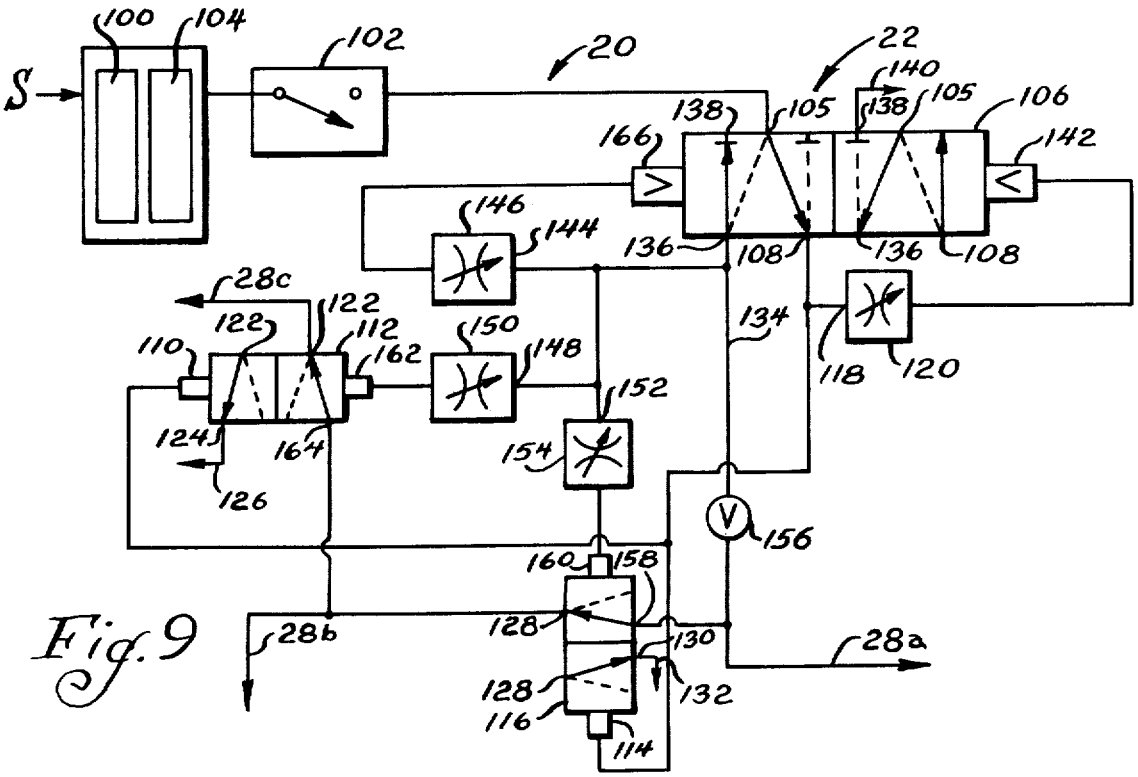
FIG. 9 is a schematic diagram of one embodiment of a pneumatic control circuit for the compression device.
Figure 10:
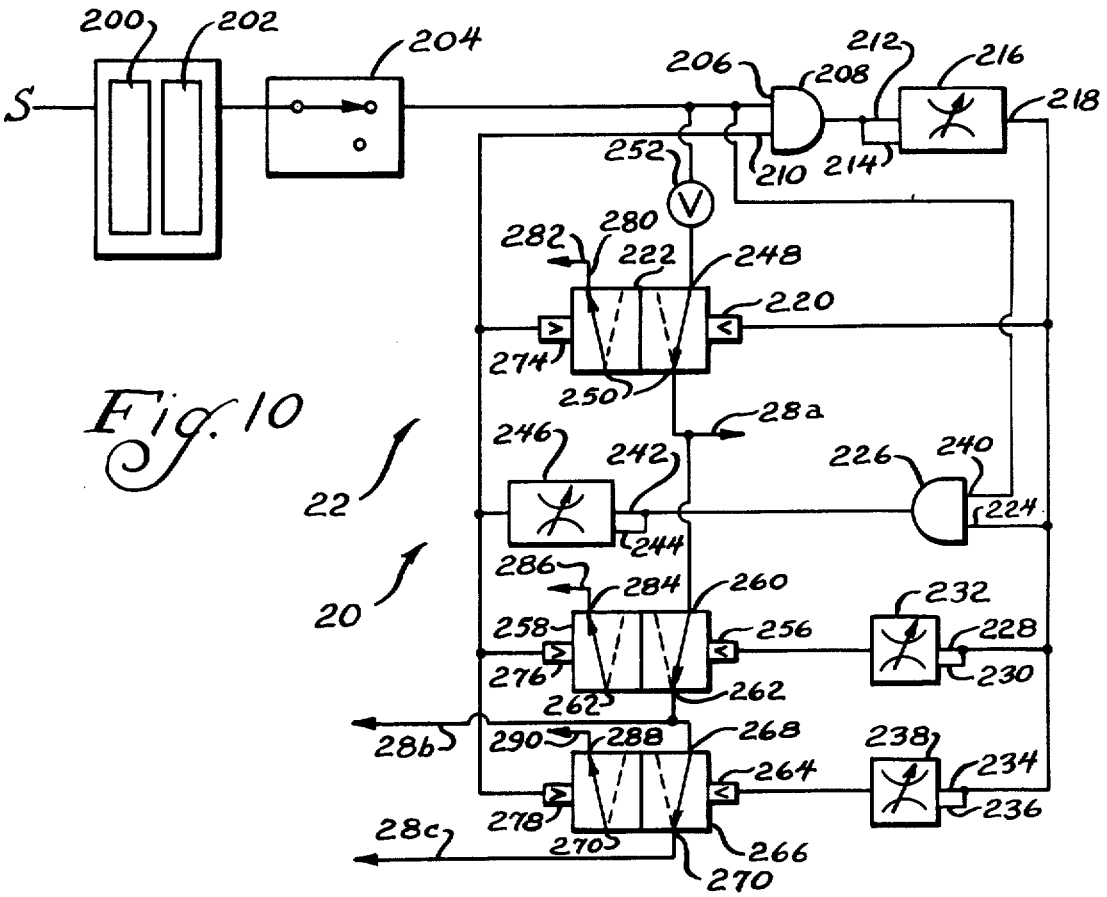
FIG. 10 is a schematic diagram of another embodiment of a pneumatic control circuit for the compression device.
Figure 11:
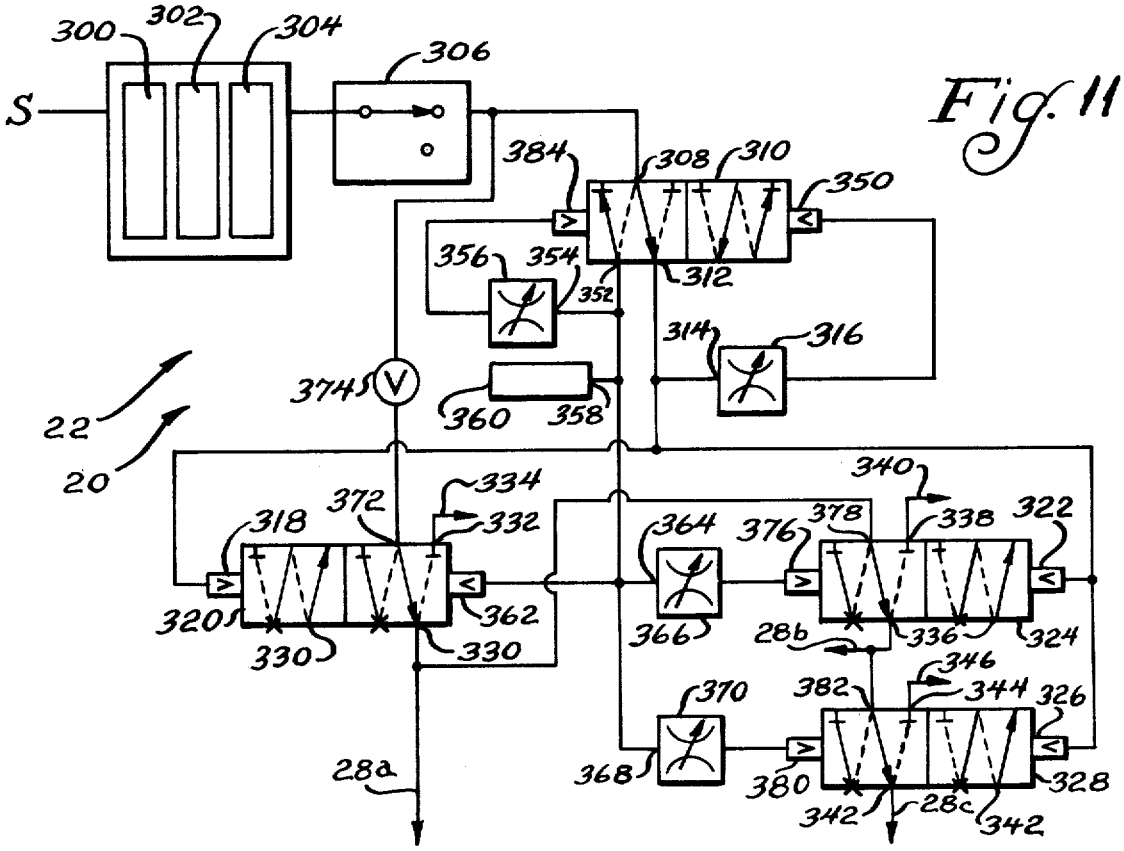
FIG. 11 is a schematic diagram of another embodiment of a pneumatic control circuit for the compression device.

Referring now to FIGS. 1, 6, and 9–11, there is shown a sequential intermittent compression device generally designated 20 for applying compressive pressures against a patient's extremities, such as the legs. The device 20 has a controller 22, as illustrated in FIGS. 9–11, a manifold 24, as shown in FIG. 6, and a pair of compression sleeves 26 for enclosing lengths of the patient's legs, as shown in FIG. 1. The controllers 22 of FIGS. 9–11 intermittently form a plurality of fluid pressure pulses from a source S of pressurized gas in a timed sequence during periodic compression or inflation cycles, and the pulses are separately applied to the manifold 24 of FIG. 6 through conduits 28*a*, 28*b*, and 28*c* at inlet ports of the manifold 24. The manifold 24 of FIG. 6 separates the pulses for passage to the separate sleeves 26 through two sets of conduits 34*a* and 34*b* which are separately connected to the sleeves, as shown in FIG. 1.

As shown in FIGS. 2–4, the sleeves 26 have a pair of flexible sheets 36 and 38 which are made from a fluid impervious material, such as polyvinyl chloride. The sheets 36 and 38 have a pair of side edges 40*a* and 40*b*, and a pair of end edges 42*a* and 42*b* connecting the side edges 40*a* and *b*. As shown in FIGS. 3 and 4, the sheets have a plurality of laterally extending lines 44, such as lines of sealing, connecting the sheets 36 and 38 together, and a pair of longitudinally extending lines 46, such as lines of sealing, connecting the sheets 36 and 38 together and connecting ends of the lateral lines 44, as shown. The connecting lines 44 and 46 define a plurality of contiguous chambers 48*a*, 48*b*, 48*c*, 48*d*, 48*e*, and 48*f* which extend laterally in the sheet, and which are disposed longitudinally in the sleeve between the end edges 42*a* and 42*b*. When the sleeve is placed on the patient's leg, the lowermost chamber 48*a* is located on a lower part of the leg adjacent the patient's ankle, while the uppermost chamber is located on an upper part of the leg adjacent the mid-thigh.

In a preferred embodiment, the side edges 40*a* and 40*b* and the connecting lines 46 are tapered from the end edge 42*a* toward the end edge 42*b*. Thus, the sleeve 26 has a reduced configuration adjacent its lower end to facilitate placement of the sleeve on the more narrow regions of the leg adjacent the patient's ankles. Moreover, it will be seen that the connecting lines 44 and 46 define chambers having volumes which progressively increase in size from the lowermost chamber 48*a* to the uppermost chamber 48*f*. The relative size of the chambers facilitates the device in conjunction with orifices to develop a compressive pressure gradient during the compression or inflation cycles which decreases from a lower part of the sleeve adjacent tne end edge 42*b* toward an upper part of the sleeve adjacent the end edge 42*a*.

As illustrated in FIGS. 3 and 4, the adjoining chambers 48*c* and 48*d* may have their adjacent portions defined by spaced connecting lines 44' and 44'' which extend laterally in the sleeve between the connecting lines 46. The sheets 36 and 38 may be severed, such as by slitting, along a line 50 between the lines 44' and 44'' to separate the adjoining chambers 48*c* and 48*d*. As shown, the severence line 50 may extend the width of the chambers between the connecting lines 46. The line 50 permits free relative movement between the adjoining chambers when the sleeve is inflated to prevent hyperextension of the leg during operation of the device, and also facilitates sizing of the sleeve to the leg of a particular patient.

The sleeve 26 may have one or more sheets 52 of a soft flexible material for covering the outside of the fluid impervious sheets 36 and 38 relative the patient's leg. The sheets 52 may be made of any suitable material, such as Tyvek, a trademark of E. I. du Pont de Nemours, and provide an aesthetically pleasing and comfortable outer surface for the sleeve 26. The sheets 52 may be attached to the sheets 36 and 38 by any suitable means, such as by lines 54 of stitching along the side edges 40*a* and *b* and end edges 42*a* and *b* which pass through the sheets 52 and sheets 36 and 38 to secure the sheets together. As shown in FIG. 2, the sheets 52 may have a plurality of openings 56 to receive a plurality of connectors 58 which are secured to the sheet 36 and which communicate with the separate chambers in the sleeve 26. As illustrated in FIG. 1, the connectors 58 are secured to the conduits 34*a* and *b*, such that the conduits separately communicate with chambers in the sleeve through the connectors 58.

As best shown in FIGS. 2 and 3, the sleeves 26 may have a plurality of hook and loop strips 60 and 62, respectively, to releasably secure the sleeves about the patient's legs. The hook strips 60 extend past one of the side edges 40*b* of the sleeve, while the loop strips 62 are secured to the outside of the outer sheet 52. During placement, the sleeves 26 are wrapped around the patient's legs, and the hook strips 60 are releasably attached to the associated loop strips 62 on the outside of the sleeves in order to secure the sleeves on the legs and confine movement of the sleeves away from the patient's legs when inflated during operation of the device.

As will be further discussed below, the controllers 22 of FIGS. 9–11 intermittently form a plurality of fluid pressure pulses in a timed sequence during the periodic inflation or compression cycles, in order to sequentially initiate inflation of different chambers in the sleeves. In the particular embodiments shown, the controllers 22 form three timed pressure pulses during each inflation cycle which are utilized to inflate the six chambers in each of the sleeves, such that each pulse is associated with two chambers in the sleeves. However, it will be understood that a timed pulse may be formed for each of the chambers in the sleeves, and that the number of timed pulses may be varied in accordance with the particular type of sleeve being used in the device.

Figure 8:
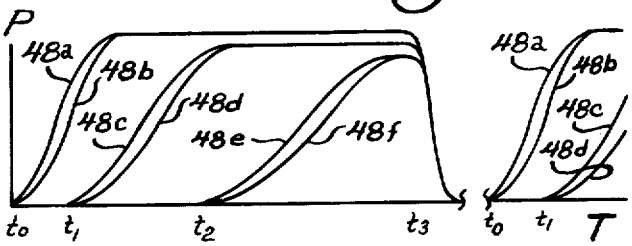
FIG. 8 is a graph illustrating pressure-time curves during operation of the compression device.

A graph of the pressures P formed in the chambers of each sleeve with respect to time T is shown in FIG. 8. The time $t_0$ designates the start of an inflation cycle when a first pressure pulse is formed by the controller, and the first pulse is applied to the two lowermost chambers in each of the sleeves at that time. As will be discussed below, the manifold separates the first pulse, and connects the separated pulses to the two lowermost chambers 48*a* and 48*b*, as designated on the corresponding curves of FIG. 8. As shown, the pulse applied to the lowermost chamber 48*a* has a faster pressure rise time than the pulse applied to the adjoining upper chamber 48*b*, such that the rate of change of pressure in the lowermost chamber 48*a* is greater than the rate of change of pressure in the adjoining chamber 48*b*. Accordingly, the sleve will exert a compressive pressure gradient against the limb which decreases from the lowermost chamber 48*a* to the adjoining upper chamber 48*b* in the lower set of adjoining chambers until the maximum pressure in the two chambers is reached and the chambers are filled.

The controller forms the second pressure pulse at the time $t_1$ during the inflation cycle, and inflation of the third and fourth chambers 48c and 48d in the sleeve is initiated at this time. It will be seen that the device initiates inflation of the third and fourth chambers while the first and second chambers are still being filled from the first pressure pulse. The second pressure pulse is also separated by the manifold for the set of the third and fourth adjoining chambers which have different pressure rise times, as shown, with the pressure rise time for the third chamber 48c being greater than the pressure rise time for the fourth chamber 48d. Thus, as in the case of the set of lowermost adjoining chambers, the rate of pressure change in the third chamber 48c is greater than the rate of pressure change in the fourth chamber 48d, such that the set of intermediate adjoining chambers also exerts a compressive pressure gradient against the limb which decreases from the third to fourth chamber. Additionally, it will be seen that the rates of pressure increases in the third and fourth chambers are less than those in the corresponding first and second chambers. Accordingly, while the third and fourth chambers are being filled, the pressures applied by the third and fourth chamber of the sleeve are less than the pressures applied by the first and second chambers, and the first, second, third, and fourth chambers thus exert a compressive pressure gradient which decreases from the lowermost chamber 48a through the fourth chamber 48d.

At the time $t_2$ the controller initiates formation of the third pressure pulse for the fifth and sixth chambers 48e and 48f. As before, the pressure rise time in the fifth chamber 48e is greater than that in the uppermost sixth chamber 48f, such that the rate of change of pressure in the fifth chamber is greater than the rate of change of pressure in the sixth chamber. Accordingly, the set of adjoining uppermost chambers applies a compressive pressure gradient against the patient's limb which decreases from the fifth to sixth chambers. As shown, the pressure rise times in the fifth and sixth chambers are less than those in the four lowermost chambers, and while the fifth and sixth chambers are being filled, the pressure in these uppermost chambers is less than the pressures in the four lowermost chambers. Thus, the sleeve applies a compressive pressure gradient against the patient's limb which decreases from the lowermost chamber 48a to the uppermost chamber 48f in the sleeve. Once reached, the maximum pressures in the two lowermost chambers 48a and 48b are generally maintained throughout the inflation cycle while the remaining chambers are still being filled. Similarly, when the maximum pressures are attained in the third and fourth chambers 48c and 48d, these pressures are generally maintained while the pressures are increased in the uppermost fifth and sixth chambers 48e and 48f. Maintenance of pressures in a lower set of chambers may be subject to slight diminution when inflation of an upper set of chambers is initiated. Finally, when the maximum pressures are obtained in the fifth and sixth chambers, all of the chambers have achieved their maximum pressures during the inflation cycle. In a preferred form, as shown, the maximum pressures attained in a lower set of chambers is greater than those in an upper set of chambers, although the maximum pressures in the various sets may approach a comparable value, as desired. In this manner, the device intermittently applies a compressive pressure gradient by the sleeve during the inflation cycles which decreases from a lower part of the sleeve to an upper part of the sleeve.

The controller initiates a deflation cycle at the time $t_3$ when the air is released from the chambers, in order to deflate the chambers and release the pressures applied by the sleeves against the limb.

The deflation cycle continues through a period of time until the subsequent time $t_0$, when the controller again initiates formation of the first pressure pulse during a subsequent inflation cycle. The controller thus intermittently forms a plurality of pressure pulses in a timed sequence for inflating the sleeves during periodic inflation cycles, and intermittently releases pressure from the sleeves during periodic deflation cycles between the inflation cycles.

As will be seen below, the time intervals initiation of the sequential pressure pulses, i.e., between times $t_0$ and $t_1$, and between times $t_1$ and $t_2$, is adjustable to modify the timed relationship of the pulse sequence. Additionally, the time interval elapsed during the inflation cycle, i.e., the time interval between times $t_0$ and $t_3$ is also adjustable to modify the duration of the periodic inflation cycles. Moreover, the time interval during the deflation cycles, i.e., the time interval between times $t_3$ and $t_0$, is adjustable to modify the duration of the periodic deflation cycles. Thus, the various time intervals associated with applying and removing the pressure gradients by the sleeves are suitably adjustable according to the physiology of the patient.

Figure 5:
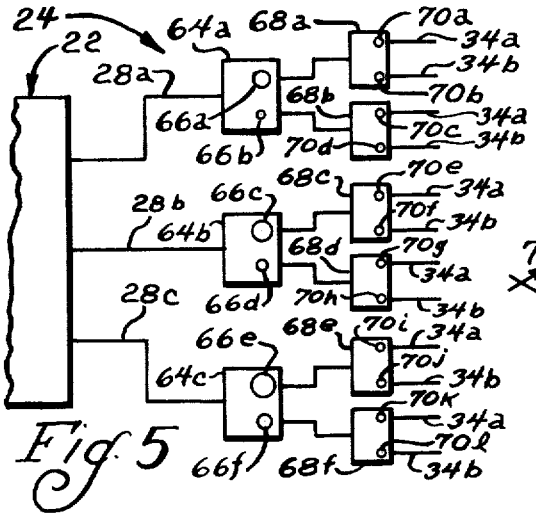
FIG. 5 is a schematic view of a manifold for use in connection with the device of FIG. 1.

The controller 22 and manifold 24 are illustrated in schematic form in FIG. 5. The controller 22 forms and applies the first pressure pulse to a first manifold section 64a through the conduit 28a. The manifold section 64a separates the first pulse through a pair of orifices 66a and 66b, and simultaneously supplies the separated first pulses to separate manifold sections 68a and 68b. In turn, the manifold section 68a further separates the pulse through orifices or ports 70a and 70b, which permit free passage of gas therethrough or are of equal size, and simultaneously supplies the separated pulses to the two lowermost chambers 48a in the pair of sleeves respectively through the associated conduits 34a and 34b. Similarly, the manifold section 68b separates the pulse through similar orifices or ports 70c and 70d, and simultaneously supplies the separated pulses to the two second chambers 48b in the pair of sleeves through the associated conduits 34a and 34b. As shown, the effective size of the orifice 66a is substantially greater than the effective size of the orifice 66b in the manifold section 64a, such that the rate of flow of gas to the manifold section 68a is greater than the rate of flow of gas to the manifold section 68b. However, the effective sizes of the orifices 70a, *b*, *c*, and *d* in the sections 68a and *b* are such that the rate of gas flow through the section 68a to the two lowermost chambers 48a in the sleeves will be the same, while the rate of gas flow through the section 68b to the two second chambers 48b in the sleeves will also be the same although less than that to the two lowermost chambers. Accordingly, the rate of gas flow through the section 64a to the two lowermost chambers 48a will be greater than the rate of gas flow through the section 64a to the two second chambers 48b, although the rate of flow to the two lowermost chambers 48a will be the same and the rate of flow to the second chambers 48b will be the same. In this manner, the lowermost chambers are filled at a greater rate than the second chambers and have faster pressure rise times, such that a compressive pressure gradient is produced in the first and second chambers of the separate sleeves which decreases from the first chamber 48*a* to the second chamber 48*b*. The relative rate of gas flow through the manifold section 64*a* may be controlled by suitable selection of the internal diameters of the orifices 66*a* and 66*b*.

The controller 22 forms and supplies the second pulse in the sequence to the manifold section 64*b*. The section 64*b* separates the second pulse through a pair of orifices 66*c* and 66*d*, with the orifice 66*c* having an effective greater size than the orifice 66*d*, such that the resulting pulse supplied to the manifold section 68*c* will have a greater flow rate than the pulse supplied to the section 68*d*. As shown, the section 68*c* separates the pulse through orifices 70*e* and 70*f*, and simultaneously supplies the separated pulses to the two third chambers 48*c* in the pair of sleeves through the associated conduits 34*a* and 34*b*. The effective sizes of the orifices 70*e* and *f* are such that the rate of gas flow into the third chambers 48*c* of the two sleeves will be approximately the same. Similarly, the section 68*d* separates the pulse supplied to this section through orifices 70*g* and 70*h*, and simultaneously supplies the resulting separated pulses to the two fourth chambers 48*d* of both sleeves through the associated conduits 34*a* and 34*b*. Again, the effective sizes of the orifices 70*g* and 70*h* are such that the rate of gas flow into the fourth chambers through conduit 34*a* and 34*b* will be approximately the same. However, since the effective size of orifice 66*c* is greater than that of orifice 66*d*, the flow rate through section 68*c* to the third chambers 48*c* is greater than that through the section 68*d* to the fourth chambers 48*d*. Thus, the pressure rise times in the third chambers of the sleeves is greater than those in the fourth chambers of the sleeves, and the third and fourth chambers apply a compressive pressure gradient against the patient's limb which decreases from the third to fourth chambers. As previously discussed in connection with FIG. 8, the second pressure pulse is formed by the controller 22 after formation of the first pulse, and the pressure rise times in the chambers decrease upwardly along the sleeve. Accordingly, the timed pulses supplied to the lower four chambers in the sleeves result in application of a compressive pressure against the patient's limb which decreases from the lowermost chamber 48*a* to the fourth chamber 48*d*.

As will be discussed below, the controller 22 forms the second pressure pulse, which is supplied to the manifold through the conduit 28*b*, from the first pressure pulse which is supplied to the manifold through the conduit 28*a*. The controller forms the second pulse in this manner to produce the progressively decreasing pressure rise times in the chamber sets and to prevent a possible inversion of the pressure gradients applied by the sleeves, since the second pressure pulse will not be formed unless the first pulse has been properly formed.

However, since both manifold sections 64*a* and *b* are supplied from the first pulse after the second pulse has been formed, a lesser filling pressure is available to the section 64*b* than was initially available to the section 64*a* before formation of the second pulse. Thus, the effective size of the orifice 66*c* of section 64*b* is made greater than that of the corresponding orifice 66*a* in the section 64*a* to obtain the desired comparable, although decreasing, pressure rise times in the corresponding first and third chambers. Similarly, the orifice 66*d* of section 64*b*, although smaller than the orifice 66*c* in the same section, has an effective greater size than the corresponding orifice 66*b* in the section 64*a* to obtain the desired comparable and decreasing pressure rise times in the corresponding second and fourth chambers. Thus, although the controller supplies gas for the second pressure pulse to the section 64*b* from the first pressure pulse, the effectively increased orifice sizes in the section 64*b* provide separate filling rates for the third and fourth chambers which are comparable to, but preferably less than, the separate filling rates for the first and second chambers of the sleeves respectively, such that the pressure rise times in the third and fourth chambers are comparable to, but preferably less than, the corresponding pressure rise times in the first and second chambers, as previously discussed in connection with FIG. 8.

The controller then forms the third pulse, and supplies this pulse to the manifold section 64*c* through the conduit 28*c*. The section 64*c* separates the third pulse through flow control orifices 66*e* and 66*f* having effective different sizes, and simultaneously supplies the separated pulses to the manifold sections 68*e* and 68*f*. In turn, the sections 68*e* and *f* separate the pulses through orifices 70*i*, 70*j*, 70*k*, and 70*l*, and simultaneously supplies separated pulses to the fifth and sixth chambers 48*e* and 48*f*, respectively, of both sleeves through the associated conduits 34*a* and 34*b*. Accordingly, the rate of gas flow from the section 64*c* through orifice 66*e* to the fifth chambers 48*e* is greater than that through the orifice 66*f* to the uppermost sixth chambers 48*f*, such that the pressure rise times in the two fifth chambers of the sleeves is greater than that in the uppermost sixth chambers of the sleeves. Thus, the fifth and sixth chambers apply a compressive pressure gradient against the patient's limb which decreases from the fifth to sixth chambers. Additionally, since the third pressure pulse is delayed relative the first two pressure pulses and since the pressure rise times in the fifth and sixth chambers is less than the corresponding lower chambers, the pressures applied by the fifth and sixth chambers against the patient's limb while being filled are less than those applied by the lower four chambers, as discussed in connection with FIG. 8, and the six chambers of the two sleeves thus combine to apply a compressive pressure gradient against the limbs which decreases from the lowermost chambers 48*a* to the uppermost chambers 48*f* of the sleeves.

As will be discussed below, the third pressure pulse supplied by the controller 22 through the conduit 28*c* is formed from the second pulse supplied through the conduit 28*b* in order to prevent an inversion of the desired pressure gradient and to provide the decreasing pressure rise times. Accordingly, the effective size of the orifice 66*e* in the section 64*c* is made greater than the effective size of the orifice 66*c* in the section 64*b*, while the effective size of the orifice 66*f* in the section 64*c* is greater than the effective size of the orifice 66*d* in the section 64*b*, which also permits the device to maintain the desired pressures in the lower chambers while filling the uppermost chambers. Thus, although the lower four sleeve chambers are driven from the first and second pulses and the third pulse is driven from the second pulse, the effective increased size of the orifices in the section 64*c* relative the sections 64*b* and 64*a* provides comparable, but decreased, pressure rise times in the uppermost fifth and sixth chambers, in a manner as previously described.

Figure 7:
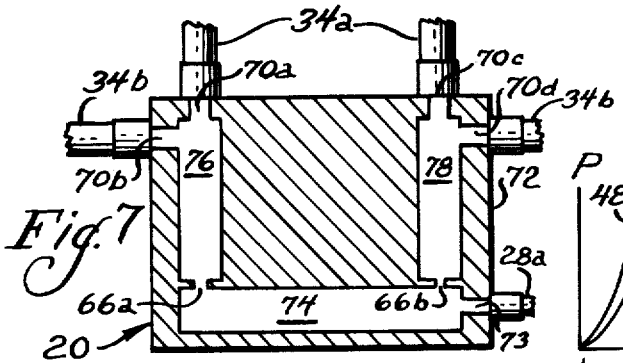
FIG. 7 is a sectional view taken substantially as indicated along the line 7—7 of FIG. 6.

Referring now to FIGS. 5–7, the first, second, and third pressure pulses are supplied to a manifold housing 72 through the conduits 28*a*, *b*, and *c*, respectively. The manner in which the first pressure pulse is separated by the manifold 24 for filling the first and second chambers 48*a* and 48*b* will be described in conjunction with FIG. 7. The first pulse is supplied through the conduit 28*a* and inlet port 73 to a channel 74 in the housing 72, and the first pressure pulse is then separated through the orifices 66*a* and 66*b* in the housing 72. As shown, the internal diameter of the orifice 66*a* is greater than the internal diameter of the orifice 66*b*, such that the rate of flow of gas from the channel 74 into the housing channel 76 is greater than the rate of flow from the channel 74 into the housing channel 78. The pulse formed in the channel 76 is separated through orifices or outlet ports 70*a* and 70*b* having an internal diameter of approximately the same size, or of sufficiently large size to prevent obstruction to passage therethrough, and the separated pulses from orifices 70*a* and *b* are then separately supplied to the two lowermost chambers 48*a* of the pair of sleeves through the associated conduits 34*a* and 34*b*. Similarly, the pulse formed in the channel 78 is separated by the orifices or outlet ports 70*c* and 70*d* having an internal diameter of approximately the same size as the orifices 70*a* and 70*b* or of non-obstructive size. The separated pulses pass from the orifices 70*c* and *d* through the associated conduits 34*a* and *b* to the two second chambers 48*b* in the pair of sleeves.

In this manner, the first pulse passing through the inlet port 73 is separated into separate pulses in the channels 76 and 78, with the pulse in the channel 76 having a faster pressure rise time than the pulse in the channel 78. In turn, the pulse in the channel 76 is separated and supplied to the two lowermost chambers in the pair of sleeves, while the pulse in the channel 78 is separated and supplied to the two second channels in the pair of sleeves. Referring to FIGS. 6 and 7, the second pressure pulse supplied to the manifold 24 through the conduit 28*b* is separated in a similar manner through a series of channels and orifices for filling the third and fourth chambers. Similarly, the third pulse, supplied to the manifold 24 through the conduit 28*c*, is separated by interconnected channels and orifices, with the resulting pulses being supplied to the uppermost fifth and sixth chambers. As shown, the manifold may have a pressure relief valve or pressure indicating device 81 secured to the housing 72 and communicating with the channel 74 or with any other channel or port, as desired.

In a preferred form, the controller 22 is composed of pneumatic components, since it is a preferred procedure to minimize electrical components in the potentially explosive environment of an operating room. Referring to FIG. 9, the controller 22 has a regulator 100 connected to the source S of pressurized gas in order to lower the supply pressure and drive the controller circuitry. The regulator 100 is connected to a two-position switch 102 through a filter 104. When the switch 102 is placed in an off condition, the gas supply is removed from the circuitry components, while the switch connects the supply to the components when placed in its on condition.

When the switch 102 is turned on, the air supply passing through the switch 102 is connected to port 105 of a two-position or shift valve 106. In a first configuration of the valve, the supply is connected by the valve through the valve port 108 to port 110 of shift valve 112, to port 114 of shift valve 116, and to port 118 of a positive output timer 120. Actuation of the shift valve 112 at port 110 causes the valve 112 to connect its port 122 to valve port 124 and exhaust line 126. Similarly, actuation of the shift valve 116 at port 114 causes the valve 116 to connect its port 128 to port 130 and exhaust line 132. Also, the valve 106 connects the line 134 through its ports 136 and 138 to the exhaust line 140.

Accordingly, when the shift valve 106 connects the gas supply through its ports 105 and 108, the controller initiates a deflation cycle during which gas passes from the sleeve chambers to the various exhaust lines, as will be seen below. At this time, the supply also initiates the timer 120 which controls the duration of the deflation cycle. The timer 120 is adjustable to modify the duration of the deflation cycle, and when the timer 120 times out, the timer actuates the shift valve 106 at port 142 to initiate an inflation cycle.

The actuated valve 106 connects the gas supply through ports 105 and 136 to port 144 of a positive output timer 146, to port 148 of a positive output timer 150, to port 152 of a positive output timer 154, and through the flow control valve 156 to port 158 of shift valve 116. The actuated valve 106 also disconnects its port 105 from port 108. The flow control valve 156 serves to reduce the relatively high pressure utilized to actuate the pneumatic components of the circuitry to a lower pressure for inflating the chambers in the sleeves.

The gas supply passing through line 134 and valve 156 also passes through the conduit 28*a* to the manifold. Accordingly, the first pressure pulse is formed through the conduit 28*a* for filling the first and second chambers 48*a* and *b* of the sleeves at this time. When the timer 154 times out, the gas supply is connected by the timer to port 160 of shift valve 116, which causes the valve 116 to connect its port 158 to port 128. Thus, the gas supply passing through flow control valve 156 is connected through the shift valve 116 to the conduit 28*b*, and the second pressure pulse is formed and supplied to the manifold for inflating the third and fourth chambers of the sleeves. It will be seen that the controller forms the second pressure pulse from the first pressure pulse which is continuously supplied to the manifold through the conduit 28*a*. The time interval between initiation of the first and second pressure pulses, respectively supplied through the conduits 28*a* and 28*b*, is controlled by the adjustable timer 154. Accordingly, the duration between formation of the first and second pressure pulses may be modified by simple adjustment of the timer 154.

When the timer 150 times out, the timer 150 connects the gas supply through the timer to port 162 of shift valve 112, causing the valve to connect its port 164 to port 122. The gas supply then passes through the ports 164 and 122 of shift valve 122 to the conduit 28*c* and manifold in order to inflate the fifth and sixth chambers of the sleeves. Accordingly, the third pressure pulse supplied to the manifold is formed at this time by the control circuitry. It will be seen that the controller forms the third pressure pulse from the second pressure pulse supplied to conduit 28*b*, which in turn is formed from the first pressure pulse, as previously described, and the first and second pressure pulses are continuously supplied to the manifold after the third pressure pulse is passed through conduit 28*c*. The time interval between initiation of the second and third pulses is determined by the adjustable timer 150, and the timer 150 may be adjusted to suitably modify the duration between the third pulse and the earlier pulses. Accordingly, the controller 22 forms a timed sequence of pressure pulses, with the time intervals between the sequential pressure pulses being adjustable, as desired.

When the timer 146 times out, the timer 146 connects the gas supply through the timer to port 166 of shift valve 106. At this time, the shift valve 106 again connects its port 105 to port 108, and disconnects the port 105 from port 136 of the valve, while the timer 120 is again actuated to begin a deflation cycle. It will be seen that the timer 146 controls the duration of the inflation cycles, since the deflation cycles are initiated when the timer 146 times out. The timer 146 also may be suitably adjusted to modify the duration of the inflation cycles.

As previously discussed, when the deflation cycles are initiated, the port 122 of shift valve 112 is connected to valve port 124 and the exhaust line 126. Thus, the two uppermost chambers 48*e* and 48*f* in the sleeves are deflated through the conduit 28*c* and the exhaust line 126 at this time. Similarly, when the valve 116 is actuated at port 114, the port 128 of shift valve 116 is connected to valve port 130 and exhaust line 132, such that the third and fourth chambers 48*c* and 48*d* are deflated through conduit 28*b* and the exhaust line 132. Finally, the shift valve 106 also connects its port 136 to port 138, such that the two lowermost chambers 48*a* and 48*b* are deflated through conduit 28*a*, valve ports 136 and 138, and exhaust line 140. In this manner, the various chambers in the sleeves are deflated during the deflation cycle. Referring to FIG. 5, it will be apparent that the pressure gradient, which decreases from a lower part of the sleeve to an upper part of the sleeve, is maintained during the deflation cycle, since the orifices in the section 64*c* are effectively larger than the corresponding orifices in the section 64*b*, while the orifices in the section 64*b* are effectively larger than the corresponding orifices in the section 64*a*. Thus, the two uppermost chambers 48*e* and *f* deflate through the orifices 66*e* and 66*f* and conduit 28*c* at a greater rate than the third and fourth chambers 48*c* and *d* through the orifices 66*c* and 66*d* in section 64*b* and conduit 28*b*. Similarly, the third and fourth sleeve chambers deflate at a greater rate than the two lowermost chambers 48*a* and *b* through orifices 66*a* and 66*b* in section 64*a* and conduit 28*a*. Accordingly, the compressive pressure gradient is maintained during inflation and deflation of the sleeves.

Referring again to FIG. 9, it will be seen that the controller 22 intermittently forms the first, second, and third pressure pulses in a timed sequence during periodic inflation or compression cycles of the device. Also, the controller intermittently deflates the chambers in the sleeve during periodic deflation or decompression cycles between the periodic inflation cycles.

Another embodiment of the controller 22 of the present invention is illustrated in FIG. 10. In this embodiment, the source of pressurized gas S is connected to a regulator 200, a filter 202, and an on-off switch 204, as described above. When the switch 204 is placed in its off configuration, the gas supply S is removed from the pneumatic components of the controller, while the supply S is connected to the components when the switch is placed in its on configuration.

When the switch 204 is turned on, the air supply S is connected to port 206 of not gate 208. When pressure is absent from port 210 of gate 208, the supply passes through port 206 of gate 208 to inlet ports 212 and 214 of a negative output timer 216. The supply actuated timer 216 at its port 212, and the supply passes through port 214 of the timer to its outlet port 218. In turn, the supply is connected to port 220 of shift valve 222, to port 224 of not gate 226, to ports 228 and 230 of a positive output timer 232, and to ports 234 and 236 of a positive output timer 238. The pressure supply at port 224 of gate 226 prevents the gate 226 from connecting port 240 of the gate 226 to ports 242 and 244 of a negative output timer 246.

The supply at valve port 220 actuates shift valve 222 which connects its port 248 to port 250, and thus the gas supply from switch 204 passes through the flow control valve 252, and ports 248 and 250 of shift valve 222, to the conduit 28*a* and manifold. The flow control valve 252 reduces the relatively high pressure of the gas supply, which is utilized to actuate the pneumatic components of the controller 22, to a lower pressure for inflation of the chambers in the sleeve. The conduit 28*a* is connected through the manifold to the two lowermost sleeve chambers 48*a* and *b*, as previously described. Thus, the device forms the first pressure pulse for filling the two lowermost chambers of the sleeves at the start of the inflation cycle.

When the positive output timer 232 times out, the timer 232 connects the gas supply from its port 230 to port 256 of shift valve 258, which then connects its port 260 to port 262. Thus, the actuated valve 258 connects the gas supply from the conduit 28*a* through its ports 260 and 262 to the conduit 28*b* and manifold for inflating the third and fourth chambers 48*c* and *d* of the sleeves, and forms the second pressure pulse from the first pressure pulse at this time, with the time interval between formation of the first and second pulses being controlled by the timer 232. As before, the duration between the first and second pulses may be modified by suitable adjustment of the timer 232.

When the positive output timer 238 times out, the timer 238 connects the supply from its port 236 to port 264 of shift valve 266. The actuated valve 266 connects its port 268 to port 270, and thus connects the gas supply from conduit 28*b* through the valve ports 268 and 270 to the conduit 28*c* and manifold. Thus, the valve 266 forms the third pressure pulse from the second pulse at this time for inflating the uppermost fifth and sixth chambers 48*e* and *f* in the sleeves. As before, the time interval between the third pulse and earlier pulses is controlled by the timer 238, and the duration between the pulses may be modified by suitable adjustment of the timer 238. It is noted at this time that the pneumatic components of the controller 22 are actuated by a portion of the circuitry which is separate from the gas supply passing through valve 252, and the conduits 28*a*, 28*b*, and 28*c* to the manifold and sleeves.

When the negative output timer 216 times out, the timer 216 removes the supply from port 220 of shift valve 222, from port 224 of gate 226, from ports 228 and 230 of timer 232, and from ports 234 and 236 of timer 238. The absence of pressure at port 224 of gate 226 causes the gate to pass the supply through gate port 240 to ports 242 and 244 of the negative output timer 246 which initiates the start of the deflation cycle. Conversely, the timer 216 initiates and controls the duration of the inflation cycle, and the duration of the inflation and deflation cycles may be modified by suitable adjustment of the timers 216 and 246, respectively.

When the timer 246 is actuated at its port 242, the timer 246 passes the gas supply from its port 244 to port 210 of gate 208, to port 274 of shift valve 222, to port 276 of shift valve 258, and to port 278 of shift valve 266. The pressure at port 210 of gate 208 causes the gate 208 to remove the supply from the ports 212 and 214 of the inflation timer 216. At the same time, the pressure at port 274 of shift valve 222 actuates the valve which connects its port 250 to port 280 and the exhaust line 282. Accordingly, the lowermost sleeve chambers 48*a* and *b* are connected by valve 222 to the exhaust line 282 through conduit 28*a*, and valve ports 250 and 280 of shift valve 222. Similarly, the pressure of port 276 of shift valve 258 actuates this valve which connects its port 262 to port 284 and the exhaust line 286. Thus, the third and fourth chambers 48*c* and *d* of the sleeves are deflated through conduit 28*b*, ports 262 and 284, and the exhaust line 286. Finally, the pressure at valve port 278 actuates shift valve 266 which connects its port 270 to port 288 and the exhaust line 290. Accordingly, the uppermost fifth and sixth chambers 48*e* and *f* of the sleeves are deflated through conduit 28*c*, valve ports 270 and 288 and the exhaust line 290. It will be seen that all the chambers in the sleeves are simultaneously deflated through the various exhaust lines 282, 286, and 290, and the compressive pressure gradient which decreases from the lower to upper part of the sleeves is maintained during deflation of the sleeves by the variously sized manifold orifices, in a manner as previously described.

When the deflation timer 246 times out, the timer 246 removes the supply from port 210 of gate 208, as well as ports 274, 276, and 278 of valves 222, 258, and 266, respectively, and the gas supply is again connected from port 206 of gate 208 to ports 212 and 214 of timer 216 to initiate another inflation cycle. It will thus be seen that the controller 22 of FIG. 10 also operates to intermittently form a plurality of pressure pulses in a timed sequence for inflating the sleeves during periodic inflation cycles, and intermittently deflate the filled sleeve chambers during periodic deflation cycles between the inflation cycles.

Another embodiment of the sequential intermittent compression controller of the present invention is illustrated in FIG. 11. As before, the source S of pressurized gas is connected to a regulator 300, after which the source passes through a primary filter 302 and an oil filter 304 to a two-position switch 306. Again, when the switch is placed in its off condition, the source or supply is removed from the pneumatic components of the circuitry, while the source is connected to the components when the switch 306 is placed in its on condition.

When the switch is turned on, the supply is connected through the switch 306 to port 308 of shift valve 310. During the deflation cycles, the valve 310 connects its port 308 to port 312, such that the gas supply is connected to port 314 of a positive output timer 316, to port 318 of shift valve 320, to port 322 of shift valve 324, and to port 326 of shift valve 328.

The actuated shift valve 320 connects its port 330 to port 332 and exhaust line 334, such that the two lowermost chambers 48*a* and *b* of the sleeves and deflated through the manifold, the conduit 28*a*, the valve ports 330 and 332, and the exhaust line 334. Also, the actuated shift valve 324 connects its port 336 to port 338 and the exhaust line 340. Accordingly, the valve 324 connects the third and fourth chambers 48*c* and *d* of the sleeves through the manifold, the conduit 28*b*, the valve ports 336 and 338, and the exhaust line 340 in order to deflate the third and fourth chambers at this time. Finally, the actuated valve 328 connects its port 342 to port 344 and the exhaust line 346. The actuated valve 328 connects the two uppermost chambers 48*e* and *f* in the sleeves through the manifold, the conduit 28*c*, the valve ports 342 and 344, and the exhaust line 346 in order to deflate the fifth and sixth chambers of the sleeves. Accordingly, at the start of the deflation cycles the chambers in the sleeves are simultaneously deflated through the exhaust lines 334, 340, and 346.

When the positive output timer 316 times out, the timer 316 connects the gas supply from port 312 of valve 310 through the timer 316 to port 350 of the shift valve 310 to actuate the valve at the start of an inflation cycle. The actuated valve 310 connects its port 308 to port 352 of the valve. In turn, the gas supply is connected to port 354 of a positive output timer 356, to port 358 of a counter 360, to port 362 of shift valve 320, to port 364 of a positive output timer 366, and to port 368 of a positive output timer 370. The actuated valve 320 connects its port 372 to port 330, and, accordingly, the gas supply is connected through the flow control valve 374, the valve ports 372 and 330, the conduit 28*a*, and the manifold to the two lowermost chambers 48*a* and *b* of the sleeves. The flow control valve 374 serves to reduce the relatively high pressure of the gas supply utilized to actuate the pneumatic components of the controller circuitry, in order to limit the supply pressure for inflating the sleeves. Accordingly, the first pressure pulse is formed by the controller 22 at this time to inflate the first and second chambers in the sleeves.

When the positive output timer 366 times out, the timer 366 connects the gas supply at port 364 of the timer to port 376 of shift valve 324. The actuated shift valve 324 connects its port 378 to port 336 and the conduit 28*b*. Thus, the controller forms a second pressure pulse at this time from the first pulse, with the second pulse being supplied through the conduit 28*b* and the manifold to the third and fourth chambers 48*c* and *d* in the sleeves. The interval of time between formation of the first and second pressure pulses is determined by the adjustable timer 366, and the duration between the pulses may be modified by suitable adjustment of the timer 366.

When the positive output timer 370 times out, the timer 370 connects the supply through its port 368 to port 380 of the shift valve 328. The actuated shift valve 328 connects its port 382 to port 342 and the conduit 28*c*. Thus, the controller 22 forms the third pressure pulse at this time which passes through the conduit 28*c* and the manifold to the uppermost chambers 48*e* and *f* in the sleeves. As before, the third pulse is formed from the second pulse which is supplied through the conduit 28*b*. The interval of time between formation of the third pulse and the earlier pulses is controlled by the timer 370, and the timer 370 may be suitably adjusted to modify the duration between the pulses. Accordingly, the timed sequence of first, second, and third pulses may be modified through adjustment of the timers 366 and 370.

The counter 360 is actuated at its inlet port 358 to increment the counter 360 by one count corresponding to each inflation cycle of the controller. A user of the device may thus determine the number of inflation cycles initiated by the device during use on a patient.

When the positive output timer 356 times out, the timer 356 connects the gas supply through its port 354 to port 384 of shift valve 310 to again start a deflation cycle. As before, the deflation timer 316 is actuated at port 314 when the shift valve 310 connects the supply through valve ports 308 and 312. Also, the actuated shift valves 320, 324, and 328 connect respective conduits 28*a*, 28*b*, and 28*c* to the exhaust lines 334, 340, and 346 to simultaneously deflate the chambers in the sleeves while maintaining a graduated pressure gradient, as previously described. It will be seen that the timer 356 controls the duration of the inflation cycles which may be suitably modified by adjustment of the timer 356. Accordingly, the controller 22 intermittently forms a plurality of pressure pulses in a timed sequence during periodic inflation cycles, and the controller intermittently deflates the pressurized chambers in the sleeves during periodic deflation cycles which take place between the inflation cycles.

The foregoing detailed description is given for clearness of understanding only, and no unnecessary limitations should be understood therefrom, as modifications will be obvious to those skilled in the art.

I claim:

1. A device for applying compressive pressures against a patient's limb from a source of pressurized fluid, comprising:

an elongated pressure sleeve for enclosing a length of the patient's limb, said sleeve having a plurality of separate fluid pressure chambers progressively arranged longitudinally along the sleeve from a lower portion of the limb to an upper portion of the limb proximal the patient's heart relative said lower portion;

means for intermittently forming a plurality of fluid pressure pulses from said source in a timed sequence during periodic compression cycles;

means for connecting different pressure pulses of said sequence to separate chambers in the sleeve in an arrangement with later pulses in said sequence being connected to more upwardly located chambers in the sleeve and with each of the pulses being continuously applied to the sleeve after formation by the forming means for the duration of the compression cycle to apply a compressive pressure gradient against the patient's limb by the sleeve which decreases from the lower to upper limb portions; and means for intermittently connecting the chambers to an exhaust means during periodic decompression cycles between said compression cycles.

2. The device of claim 1 wherein the pulse connecting means connects separate pressure pulses to spaced chambers in the sleeve.

3. The device of claim 1 wherein the pulse connecting means connects at least one of said pressure pulses to more than one chamber in said sleeve.

4. The device of claim 3 wherein the pulse connecting means connects said one pulse to adjoining chambers in the sleeve.

5. The device of claim 1 wherein the pulse connecting means connects each of said pressure pulses to sets of adjoining chambers in the sleeve.

6. The device of claim 5 wherein the pulse connecting means connects each pressure pulse to a pair of adjoining chambers.

7. The device of claim 5 wherein the pulse connecting means connects different pulses to contiguous sets of adjoining chambers.

8. The device of claim 5 including means for progressively decreasing the rate of pressure increases in progressively located upper chambers of each adjoining chamber set.

9. The device of claim 8 wherein the decreasing means comprises, manifold means having a plurality of flow control orifices having an effective decreasing size associated with progressively located upper chambers in each of said sets.

10. The device of claim 9 wherein the size of said orifices associated with the chambers in each set is effectively larger than the orifice size of corresponding chambers in any lower chamber set.

11. The device of claim 5 wherein the number of chambers in each of said sets is the same.

12. The device of claim 1 wherein the forming means initiates formation of a pressure pulse at the start of each compression cycle.

13. The device of claim 1 wherein the forming means initiates formation of separate pulses at timed intervals during said compression cycle.

14. The device of claim 13 including means for adjusting the duration between initiation of the separate pulses.

15. The device of claim 1 including means for adjusting the timed sequence of said pressure pulses.

16. The device of claim 1 including means for adjusting the duration of said compression cycles.

17. The device of claim 1 including means for adjusting the duration of said decompression cycles.

18. The device of claim 1 wherein the forming means forms later pulses in said sequence from a preceding pulse in the sequence.

19. The device of claim 18 wherein the forming means forms each later pulse from an immediately prior pulse in the sequence.

20. The device of claim 1 including means for developing progressively decreasing rates of pressure increases in progressively located upper chambers in the sleeve.

21. The device of claim 1 wherein the pulse connecting means applies pulses of progessively decreasing maximum pressure during each compression cycle.

22. The device of claim 1 wherein the sleeve defines progressively increasing volumes in said chambers progressively upwardly along the sleeve.

23. The device of claim 1 wherein the decompression connecting means simultaneously connects the chambers to the exhaust means.

24. The device of claim 1 wherein the decompression connecting means includes means for maintaining progressively located upper chambers at progressively decreasing pressures during decompression of the sleeve.

25. The device of claim 24 wherein the maintaining means comprises, flow control orifice means associated with each pressure pulse, with the orifice means associated with a pulse connected to a given chamber having an effective larger size than the orifice means associated with another pulse connected to a corresponding lower chamber.

26. The device of claim 1 including a second elongated pressure sleeve for enclosing a length of another patient's limb, said second sleeve having a plurality of separate fluid pressure chambers progressively arranged longitudinally along the second sleeve from a lower portion of the limb to an upper portion of the limb proximal the patient's heart relative the lower portion, and in which the connecting means separately connects each of the different pressure pulses to corresponding chambers in the sleeves.

27. A device for applying compressive pressures against a patient's limb from a source of pressurized fluid, comprising:

an elongated pressure sleeve for enclosing a length of the patient's limb, said sleeve having a plurality of separate fluid pressure chambers progressively arranged longitudinally along the sleeve from a lower portion of the limb to an upper portion of the limb proximal the patient's heart relative the lower portion;

means for intermittently connecting said source in a timed sequence successively to more upwardly located separate chambers in the sleeve and continuously applying the source to the connected chambers during periodic compression cycles and for controlling the rate of pressure increases in the separate chambers at lesser rates in more upwardly located chambers to apply a compressive pressure gradient against the patient's limb by the sleeve which decreases from the lower to upper limb portions; and means for intermittently connecting the chambers to an exhaust means during periodic decompression cycles between said compression cycles.

28. A device for applying compressive pressures against a patient's limb from a source of pressurized fluid, comprising:

an elongated pressure sleeve for enclosing a length of the patient's limb, said sleeve having a plurality of separate fluid pressure chambers progressively arranged longitudinally along the sleeve from a lower portion of the limb to an upper portion of the limb proximal the patient's heart relative the lower portion;

means for intermittently forming a plurality of fluid pressure pulses from said source in a timed sequence during periodic compression cycles;

means for connecting different pressure pulses of said sequence to separate sets of plural adjoining chambers in an arrangement with later pulses in said sequence being connected to more upwardly located chamber sets to apply a compressive pressure gradient against the patient's limb by the sleeve which decreases from the lower to upper limb portions; and means for intermittently connecting the chambers to an exhaust means during periodic decompression cycles between said compression cycles.

29. The device of claim 28 wherein said chamber sets are contiguous.

30. The device of claim 28 including means for progressively decreasing the rate of pressure increases in progressively located upper chambers of each chamber set.

31. The device of claim 30 wherein the decreasing means comprises, manifold means having a plurality of flow control orifices having an effective decreasing size associated with progressively located upper chambers in each of said sets.

32. The device of claim 28 including means for progressively decreasing the rate of pressure increases in progressively located upper chamber sets.

33. A device for connecting a fluid pressure controller to a multi-chamber compression sleeve comprising, a manifold having inlet port means for connection to said controller, a plurality of outlet ports for connection to separate chambers in the sleeve, and a plurality of flow control orifices communicating between said inlet port means and different outlet ports, said orifices being arranged in separate sets of equal number with the orifices in each of said sets progressively decreasing in effective size to progressively diminish the fluid flow rate through the orifices, with corresponding orifices from separate sets having an effective increasing size to progressively increase the rate of fluid flow through different orifice sets.

34. The device of claim 33 including a pair of outlet ports communicating with each of said orifices.

35. A device for controlling the operation of a compression sleeve from a source of pressurized gas, comprising:

means for sequentially connecting said source at timed intervals to a plurality of separate outlet ports during an inflation cycle;

means for controlling the duration of the timed intervals of the connecting means, the controlling means being capable of adjusting the duration of at least one of said intervals without modifying the duration of at least one of the other intervals;

means for intermittently initiating the connecting means during periodic inflation cycles; and means for intermittently disconnecting the source from the outlet ports during periodic deflation cycles between said inflation cycles.

36. The device of claim 35 wherein the disconnecting means includes means for connecting the outlet ports to an exhaust means during each deflation cycle.

37. The device of claim 35 including means for controlling the duration of said deflation cycles.

38. The device of claim 37 wherein said controlling means is adjustable to modify the duration of said deflation cycles.

39. The device of claim 35 including means for controlling the duration of said deflation cycles.

40. The device of claim 39 wherein said controlling means is adjustable to modify the duration of said inflation cycles.

41. A device for controlling the operation of a compression sleeve from a source of pressurized gas, comprising:

means for intermittently initiating periodic inflation cycles at the end of periodic deflation cycles;

means responsive to the initiating means for forming a plurality of fluid pressure pulses from said source in a timed sequence during said inflation cycles;

means for controlling the pressure rise times of said plural pulses at varying rates; and means for intermittently initiating the periodic deflation cycles at the end of the inflation cycles.

* * * * *